US007635065B1

(12) United States Patent
Pettinger

(10) Patent No.: US 7,635,065 B1
(45) Date of Patent: Dec. 22, 2009

(54) SUCTION FREE WASTE RECEPTACLE APPARATUS

(76) Inventor: Karl D. Pettinger, 9114 Rifle Rd., East Canton, OH (US) 44730

( * ) Notice: Subject to any disclaimer, the term of this patent is extended or adjusted under 35 U.S.C. 154(b) by 385 days.

(21) Appl. No.: 11/551,972

(22) Filed: Oct. 23, 2006

(51) Int. Cl.
*B65D 25/14* (2006.01)
*B65D 35/14* (2006.01)
*B65D 90/00* (2006.01)

(52) U.S. Cl. ..... 220/495.04

(58) Field of Classification Search ..... 220/62.18, 220/495.04, 495.06, 676, 908.1, 669–671
See application file for complete search history.

(56) References Cited

U.S. PATENT DOCUMENTS 4,416,197 A 11/1983 Kehl
4,905,945 A 3/1990 Peterson
5,690,247 A 11/1997 Boover
7,438,199 B1 * 10/2008 Tidrick ..... 220/495.04

* cited by examiner

*Primary Examiner*—Harry A Grosso
(74) *Attorney, Agent, or Firm*—Crossley Patent Law; Mark Ashley Crossley

(57) ABSTRACT

A suction free waste receptacle apparatus provided in a plurality of embodiments, the apparatus providing suction relief whereby a flexible trash bag suction to the apparatus is negated, thereby affording easier bag placement and removal from the apparatus. The apparatus prevents spillage of trash and liquids from a leaking bag. The apparatus combines rigidity with light weight using a reinforcing rib structure.

8 Claims, 4 Drawing Sheets

SUCTION FREE WASTE RECEPTACLE APPARATUS

BACKGROUND OF THE INVENTION

Removing a trash bag from a typical trash usually confronts the user with suction developed between the bag and the trash can which the bag temporarily resides within. The suction developed resists removal of the trash bag. Removal of the trash bag then often becomes a two-person endeavor, with one holding the can and one pulling the bag. Torn trash bags and spills are not unusual. Various methods of solving the problem have also met with difficulties. As example of the difficulties encountered, trash material and especially liquids often spill from torn bags within the trash can, when such cans offer breathing directly to the exterior of the can. Bags often leak and fail, and suction relief holes which provide trash material and liquid escape are not desirable. A new approach is needed in a trash can apparatus that provides for easy removal of trash bags.

FIELD OF THE INVENTION

The suction free waste receptacle apparatus relates to trash cans and waste receptacles and more especially to a suction free waste receptacle apparatus which provides easier trash bag insertion and removal.

DESCRIPTION OF THE PRIOR ART

Prior related art U.S. Pat. No. 5,690,247 issued to Boover on Nov. 25, 1997 teaches a wastebasket for removing and retaining a trash can liner which provides openings from the inside of the wastebasket to the outside, thereby inviting transfer of spills within the wastebasket to the outside of the wastebasket. The device does not provide the support and suction relief as is offered by the present apparatus. U.S. Pat. No. 4,416,197 issued to Kehl on Jan. 22, 1983 teaches a waste material compactor which provides holes completely through the side walls. The apparatus thereby provides the opportunity for leaking from the container. U.S. Pat. No. 4,905,945 issued to Peterson on Mar. 6, 1990 teaches a refuse can stabilizing apparatus which supports a refuse can. While providing a can support, the device is not designed to offer the suction free waste receptacle of the present apparatus.

While the above-described devices fulfill their respective and particular objects and requirements, they do not describe a suction free waste receptacle apparatus that provides for the advantages of the present suction free waste receptacle apparatus. In this respect, the present suction free waste receptacle apparatus substantially departs from the conventional concepts and designs of the prior art. Therefore, a need exists for an improved suction free waste receptacle apparatus.

SUMMARY OF THE INVENTION

The general purpose of the suction free waste receptacle apparatus, described subsequently in greater detail, is to provide a suction free waste receptacle apparatus which has many novel features that result in an improved suction free waste receptacle apparatus which is not anticipated, rendered obvious, suggested, or even implied by prior art, either alone or in combination thereof. To attain this, the suction free waste receptacle apparatus To attain this the apparatus is provided in more than one embodiment. Each embodiment comprises a vessel with a plurality of ventilation openings proximal to a bottom of the vessel. The first embodiment is a one-piece apparatus. The first embodiment provides a vessel with externally disposed ribs. Each rib further comprises a tube within. Each tube has an upper opening venting to the atmosphere. Each tube further comprises a lower opening which passes through the outer wall surface and the inner wall surface of the vessel. Each tube opening is disposed proximal to the bottom of the vessel. Each rib to vessel juncture is twice reinforced with opposing angles. Allowing the bottom of the vessel to breath freely to the atmosphere negates suction and pressure and provides for easy removal and installation of a flexible trash bag within the apparatus. The ribs also strengthen the vessel.

An added embodiment of the apparatus provides a two-piece construction. The vessel is open at both top and bottom. The bottom of the vessel is provided with a plurality of lower openings through the outer wall surface and the inner wall surface. The bottom of the vessel removably rests within the base provided. The base is of a diameter larger than the vessel. The base has a height which preferably exceeds the height of the lower openings of the vessel.

Yet another embodiment of the apparatus provides a one-piece construction with a base having a diameter greater than the vessel and a height. The base is joined to the vessel at the bottom of the vessel. The base is also preferably reinforced with a lip at a top of the height of the base. The vessel is provided with a plurality of openings at a height of the vessel whereby the lower openings are lower than the base height.

All embodiments of the apparatus provide for potential trash bag leaks. Rather than broken or leaking bag spilling trash bag contents, each embodiment of the apparatus contains any such spills.

Thus has been broadly outlined the more important features of the improved suction free waste receptacle apparatus so that the detailed description thereof that follows may be better understood and in order that the present contribution to the art may be better appreciated.

An object of the suction free waste receptacle apparatus is to provide suction free removal of trash bags from the receptacle.

Another object of the suction free waste receptacle apparatus is to provide an adequately supported receptacle.

And, an object of the suction free waste receptacle apparatus is to provide a lightweight apparatus.

Further, an object of the suction free waste receptacle apparatus is to provide foot resistance whereby a user may resist upward movement of the receptacle during trash bag removal.

Additionally, an object of the suction free waste receptacle apparatus is to prevent trash leakage, especially liquids.

Further objects, features and advantages of the improved suction free waste receptacle apparatus will be readily apparent to those of ordinary skill in the art upon reading the following detailed description of presently preferred, but nonetheless illustrative, embodiments of the improved suction free waste receptacle apparatus when taken in conjunction with the accompanying drawings.

In this respect, before explaining the current embodiments of the improved suction free waste receptacle apparatus in detail, it is to be understood that the suction free waste receptacle apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved suction free waste receptacle apparatus. It is therefore important that the claims be regarded as including such equivalent constructions insofar as they do not depart from the spirit and scope of the suction free waste receptacle apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the suction free waste receptacle apparatus generally designated by the reference number 10 will be described.

Figure 1:
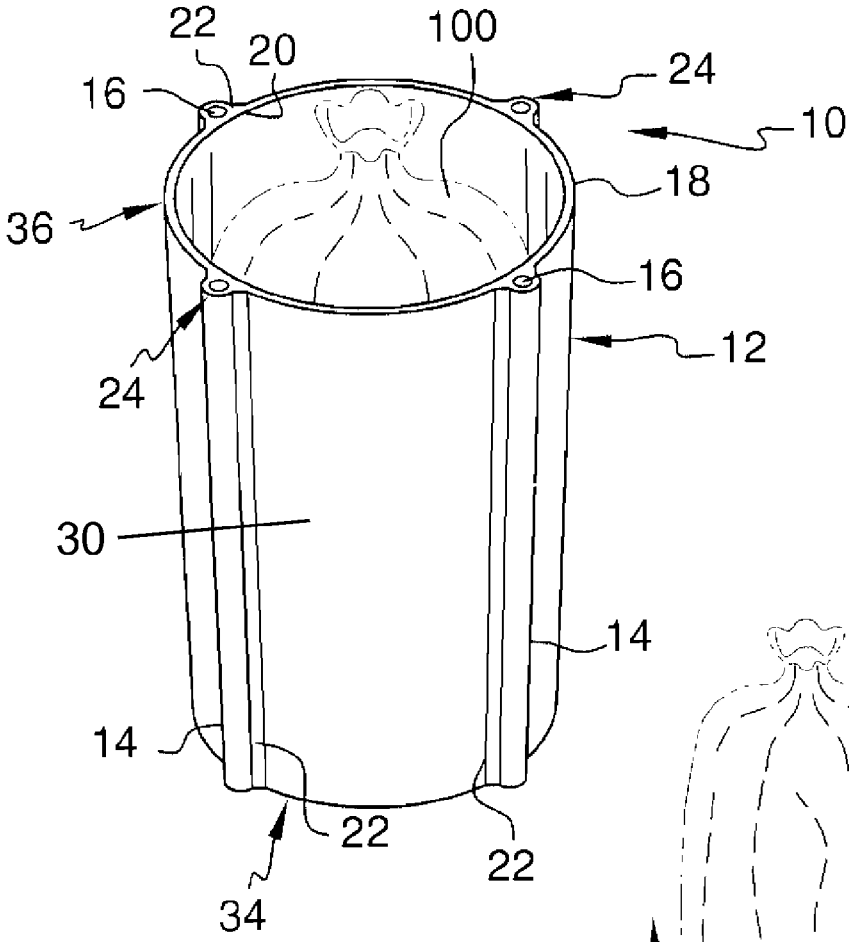
FIG. 1 is a perspective view of one embodiment of the apparatus, flexible trash bag within.
Figure 2:
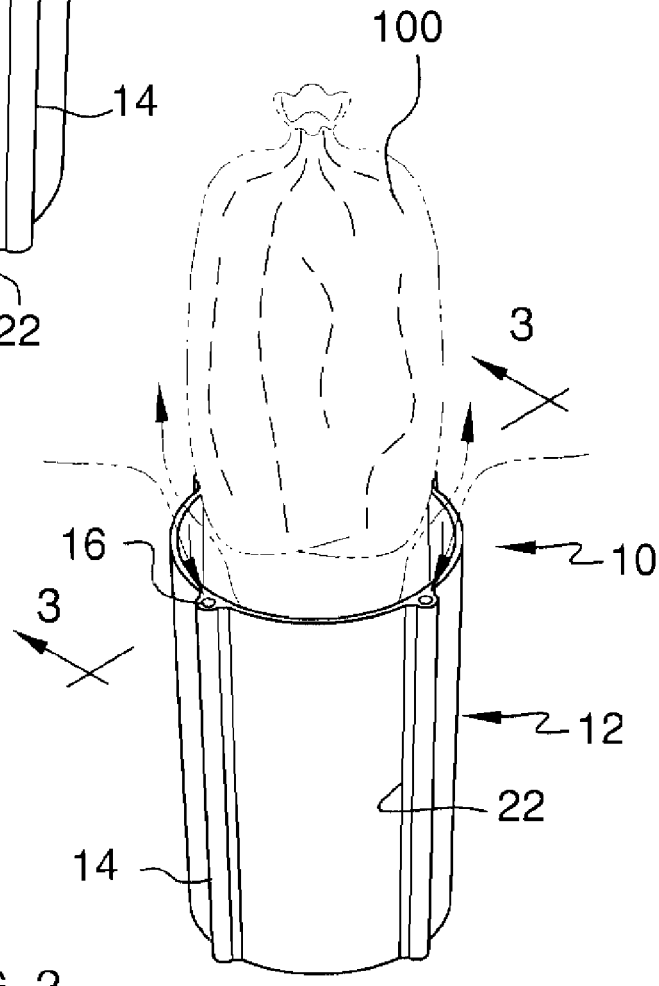
FIG. 2 is a perspective view of the apparatus of FIG. 1, the trash bag removed.
Figure 3:
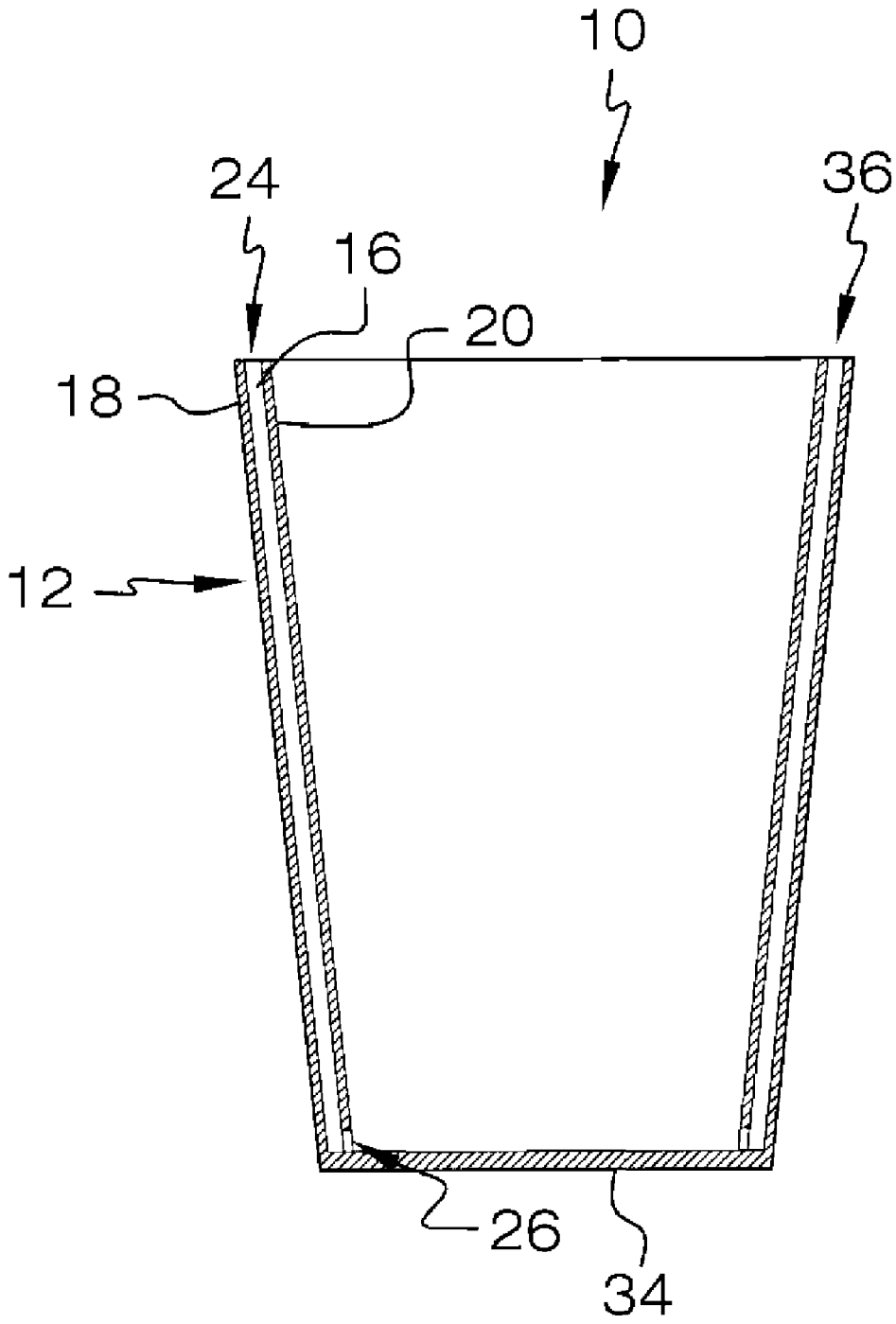
FIG. 3 is a cross sectional view of FIG. 2.

Referring to FIGS. 1, 2, and 3, the embodiment of the suction free waste receptacle apparatus 10 is for use in removably containing flexible trash bags 100. The apparatus 10 comprises a hollow vessel 12. The vessel 12 has a height, an open top 36 and a closed bottom 34. The apparatus 10 further comprises a unitary wall 30 comprising an outer wall surface 18 and an inner wall surface 20. A plurality of vertical ribs 14 is affixed along the outer wall surface 18 and are exposed. The ribs 14 are a continuous part of the vessel 12. A tube 16 is disposed within each rib 14. An upper opening 24 is disposed within each tube 16. The upper opening 24 is at the top of each tube 16. A lower opening 26 is disposed in each tube 16. The lower opening 26 extends through the inner wall surface 20 and the outer wall surface 18. Preferably, each rib 14 extends the entire height of the vessel 12. However, other embodiments of the apparatus 10 are provided wherein rib 14 height is abbreviated to less than the height of the vessel 12. Four vertical ribs 14 are provided in the illustration. More or less ribs 14 may be provided in various embodiments. Preferably, each rib 14 is further comprised of a pair of angles 22. Each angle 22 joins an opposite side of each rib 14 to the vessel 12 outer wall surface 18. Each rib 14 thereby reinforces the vessel properly. Further, each angle 22 prevents undue stress at the juncture of each rib to the vessel 12, thereby negating potential failure of rib 14 to vessel 12 juncture.

Figure 4:
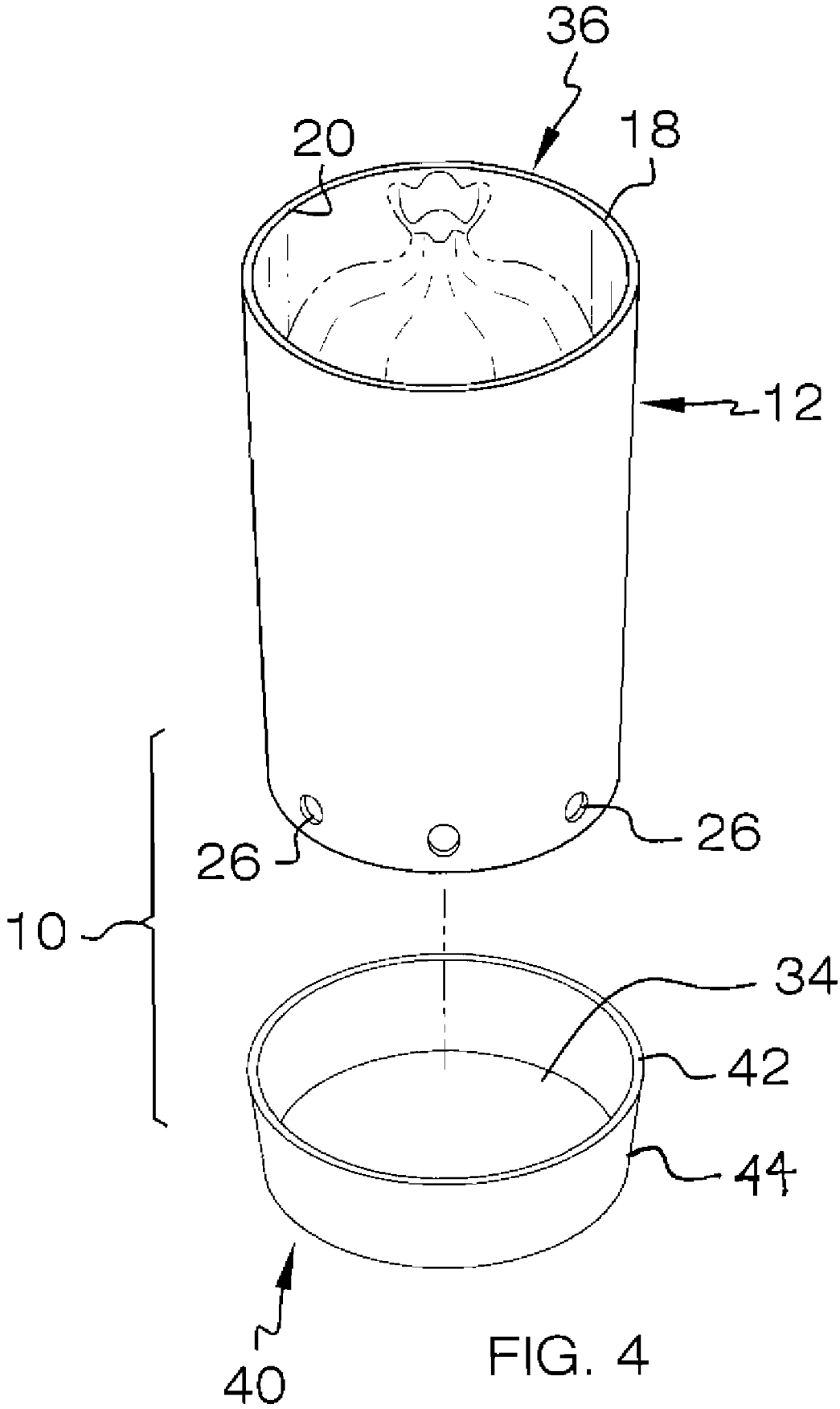
FIG. 4 is a perspective view of an embodiment of the apparatus, the embodiment having a separate vessel and base.

Referring to FIG. 4, the alternate embodiment of the apparatus 10 comprises a suction free waste receptacle apparatus 10 for use in removably containing flexible trash bags 100. The embodiment of the apparatus 10 comprises a hollow vessel 12. The vessel 12 has a height, an open top 28 and bottom 34. The vessel 12 has an outer wall surface 18 and an inner wall surface 20. The vessel 12 has a diameter. A plurality of lower openings 26 extend through the inner wall surface 20 and outer wall surface 18. The lower openings 26 are proximal to the bottom 34 of the vessel 12. At least 4 lower openings 26 are provided in the vessel 12. Further embodiments of the FIG. 4 embodiment of the apparatus 10 provide varied numbers of lower openings 26. The base 40 is provided for removable receipt of the bottom 34 of the vessel 12. The base 40 has a diameter larger than the diameter of the vessel 12. The base 40 is preferably slightly conical in shape, with the large diameter of the conical shape uppermost. The base 40 has a bottom 34 and an open top 36. The base 40 has an outer perimeter 44 with a height. The lip 42 is disposed at the top of the height of the outer perimeter 44. The base 40 of this embodiment provides for optionally foot resistance to upward movement of the apparatus 10.

Figure 5:
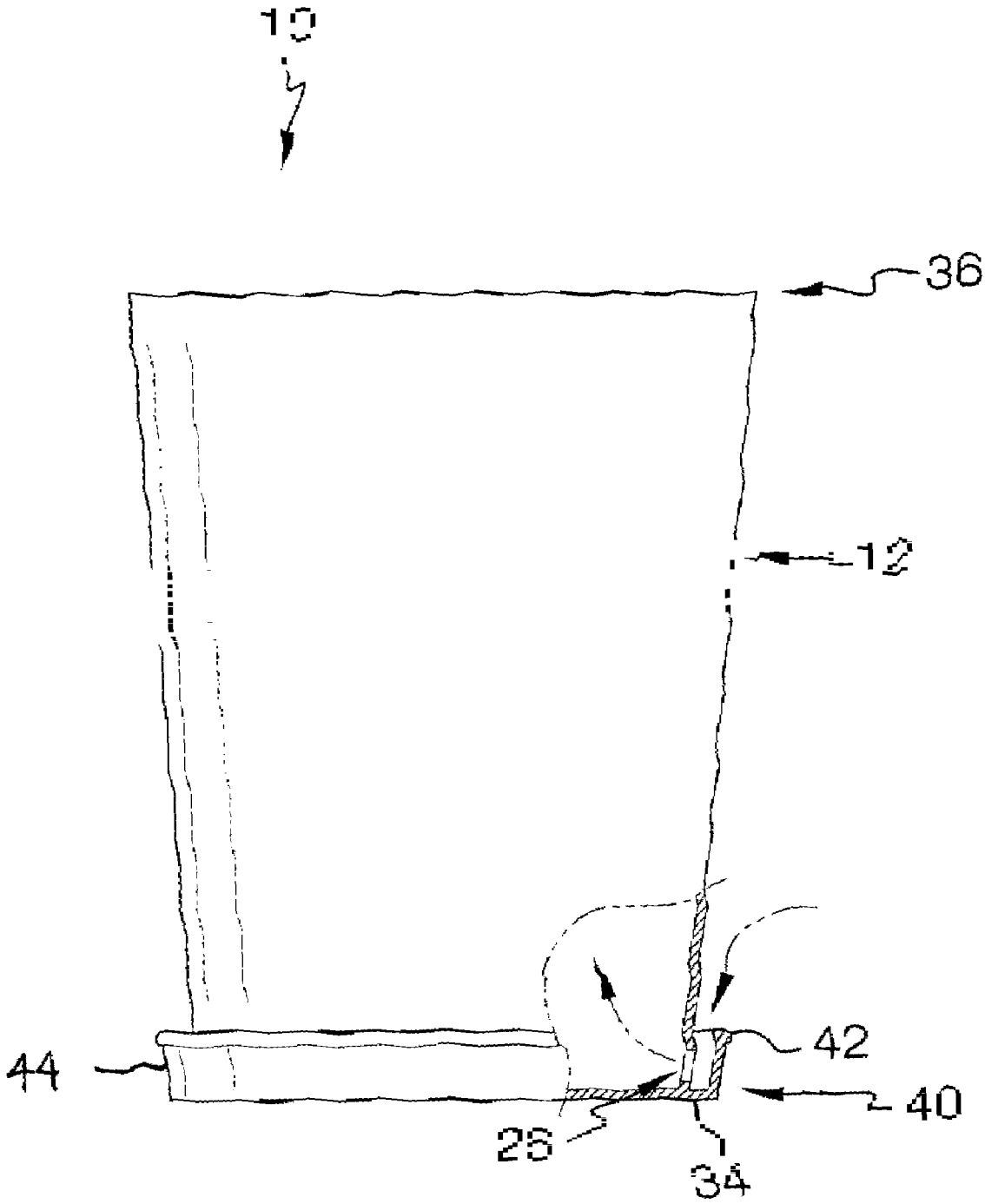
FIG. 5 is a partial cross sectional view of an embodiment of the apparatus.

Referring to FIG. 5, the suction free waste receptacle apparatus 10 for use in removably containing flexible trash bags 100 comprises a hollow vessel 12. The vessel 12 has a height, an open top 36 and a bottom 34. The vessel 12 further comprises an outer wall surface 18 and an inner wall surface 20. The vessel 12 has a diameter. A plurality of lower openings 26 extend through the inner wall surface 20 and outer wall surface 18. The lower openings 26 are proximal to the bottom 34 of the vessel 12. The base 40 is joined to the bottom 34 of the vessel 12. The base 40 has a diameter larger than the diameter of the vessel 12. The base 40 has a bottom 34 and an open top. The base 40 has a perimeter 44 with a height. The base 40 is preferably conically shaped with the widest diameter of the perimeter 44 uppermost. The lower openings 26 of the vessel 12 are preferably at a height lower than the height of the base 40. The base 40 preferably further comprises a lip 42 at the top of the height of the perimeter 44 of the base 40. The lip 42 provides strength to the base 40 and the perimeter 44.

With respect to the above description then, it is to be realized that the optimum dimensional relationships for the parts of the suction free waste receptacle apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the suction free waste receptacle apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the suction free waste receptacle apparatus may be used.

Therefore, the foregoing is considered as illustrative only of the principles of the suction free waste receptacle apparatus. Further, since numerous modifications and changes will readily occur to those skilled in the art, it is not desired to limit the suction free waste receptacle apparatus to the exact construction and operation shown and described, and accordingly, all suitable modifications and equivalents may be resorted to, falling within the scope of the suction free waste receptacle apparatus.

What is claimed is:

1. A suction free waste receptacle apparatus for use in removably containing flexible trash bags, the apparatus comprising:

a hollow vessel, the vessel having a height, an open top, a closed bottom, a unitary wall comprising an outer wall surface and an inner wall surface;

a plurality of vertical ribs affixed externally along the outer wall surface wherein said ribs are exposed;

a tube within each rib;

an upper opening in each tube;

a lower opening in each tube, the lower opening through the inner wall surface.

2. The apparatus in claim 1 wherein each rib extends the entire height of the vessel.

3. The apparatus in claim 1 wherein at least 3 vertical ribs are provided.

4. The apparatus in claim 2 wherein at least 3 vertical ribs are provided.

5. The apparatus in claim 1 wherein each rib is further comprised of a pair of angles, each angle joining an opposite side of each rib to the vessel outer wall surface.

6. The apparatus in claim 2 wherein each rib is further comprised of a pair of angles, each angle joining an opposite side of each rib to the vessel outer wall surface.

7. The apparatus in claim 3 wherein each rib is further comprised of a pair of angles, each angle joining an opposite side of each rib to the vessel outer wall surface.

8. The apparatus in claim 4 wherein each rib is further comprised of a pair of angles, each angle joining an opposite side of each rib to the vessel outer wall surface.

* * * * *